US006116669A

United States Patent [19]

Scaglia

[11] Patent Number: 6,116,669

[45] Date of Patent: Sep. 12, 2000

[54] DEVICE TO AUTOMATICALLY ATTACH A BOBBIN-BEARING SHAFT TO A MANDREL OF A MACHINE

[75] Inventor: Enzo Scaglia, Milan, Italy

[73] Assignee: Scaglia SPA, Brembilla, Italy

[21] Appl. No.: 09/272,355

[22] Filed: Mar. 19, 1999

[30] Foreign Application Priority Data

Mar. 20, 1998 [IT] Italy ..... UD98A0044

[51] Int. Cl.[7] ..... B66C 1/10; B66C 1/54

[52] U.S. Cl. ..... 294/67.22; 294/67.5; 294/97; 242/571.4; 242/559.1; 414/910

[58] Field of Search ..... 242/571.4, 571.5, 242/592, 559.1; 294/67.2, 67.22, 67.5, 95, 97; 414/910, 911, 27

[56] References Cited

U.S. PATENT DOCUMENTS

| | | | |
|---|---|---|---|
| 2,175,755 | 10/1939 | Matteson . | |
| 2,268,887 | 1/1942 | Matteson . | |
| 2,875,909 | 3/1959 | Babick et al. | 414/27 |
| 3,495,781 | 2/1970 | Graf . | |
| 3,554,455 | 1/1971 | Graf . | |
| 4,007,882 | 2/1977 | Isoard . | |
| 4,046,264 | 9/1977 | Bergman et al. | 414/27 |
| 4,204,797 | 5/1980 | Rohrscheid | 414/911 |
| 4,358,143 | 11/1982 | Cullen . | |
| 4,400,872 | 8/1983 | Berges | 414/27 |
| 4,557,515 | 12/1985 | Read | 294/95 |
| 4,600,163 | 7/1986 | Hummel et al. | 294/97 |
| 4,708,574 | 11/1987 | Conboy et al. | 294/95 |
| 5,310,131 | 5/1994 | Monaco et al. | 414/911 |
| 5,332,351 | 7/1994 | Nelson . | |
| 5,437,528 | 8/1995 | Decker | 242/559.1 |
| 5,803,652 | 9/1988 | Martin . | |

FOREIGN PATENT DOCUMENTS

| | | |
|---|---|---|
| 567917 | 11/1993 | European Pat. Off. . |
| 8900971 | 2/1989 | WIPO . |

*Primary Examiner*—Dean J. Kramer
*Assistant Examiner*—Paul T. Chin
*Attorney, Agent, or Firm*—Antonelli, Terry, Stout & Kraus, LLP

[57] ABSTRACT

Device to automatically attach a first bobbin-bearing mandrel (11) to a second mandrel (15) of a machine, wherein the first mandrel (11) and the second mandrel (15) have substantially the same outer diameter and are suitable to be inserted selectively into the central hole of the bobbin (13), coupling mechanism (40, 50) being provided on the first mandrel (11) to selectively couple with the second mandrel (15), to allow the coaxial transfer of the bobbin (13) from one to the other of the mandrels (11 and 15).

13 Claims, 3 Drawing Sheets

DEVICE TO AUTOMATICALLY ATTACH A BOBBIN-BEARING SHAFT TO A MANDREL OF A MACHINE

FIELD OF THE INVENTION

This invention concerns a device to automatically attach a bobbin-bearing shaft member or mandrel to a mandrel or shaft member of a machine, as set forth in the main claim.

More in particular, the invention refers to a device suitable to automatically couple the shaft member of an apparatus to transfer a bobbin, removed from a work or storage station, with the rotatable mandrel of a machine in which the coiled material has to be subjected to processing.

BACKGROUND OF THE INVENTION

In the state of the art, bobbins are moved from one side of the same machine to the other side, or from one machine to another, or from a pallet to the machine, by means of transport apparatus mounted on an upper trolley, sliding on the appropriate guides or rails which define the path which the apparatus can follow, or on a flag-type or pantograph arm or in any case by means of some kind of manipulator. These devices are provided with an arm at the lower end of which there is a shaft or mandrel attached, which shaft is suitable to be inserted into the central tube, or nucleus, of the bobbin. The arm is usually pivoting with respect to the sliding trolley and is articulated at one or more points, so as to allow the bobbin-bearing mandrel to be oriented at will in the free space, and thus to assume the desired angle, with respect to both the horizontal plane and the vertical plane.

When the apparatus reaches the predetermined destination, with the bobbin-bearing mandrel arranged substantially coaxial with the working mandrel, the bobbin is transferred manually from one mandrel to the other mandrel.

It is possible to do this without serious problems only if the bobbins weigh at most a few dozen kilograms.

With bobbins in the state of the art becoming larger and larger, with a weight which nowadays is in the region of hundreds of kilograms, transferring the bobbin manually from the mandrel to the working shaft is not only very difficult for those performing the operation, but also very dangerous. In fact, it could happen that, when the bobbin is axially thrust to detach it from the first mandrel and insert it into the other or working mandrel, the first mandrel, since in most cases it is mounted pivoting on the apparatus, might be axially displaced with respect to the second mandrel, with the consequent danger that, it the bobbin is not yet sufficiently inserted into the second mandrel, it might fall and consequently be damaged and cause damage in turn to persons or things.

Applicant has designed and embodied this invention to overcome these shortcomings and to obtain further advantages.

SUMMARY OF THE INVENTION

This invention is set forth and characterised in the main claim, while the dependent claims describe other characteristics of the invention.

The principal purpose of the invention is to achieve a device to automatically attach a bobbin-bearing shaft or mandrel to a second shaft or mandrel of a machine in such a manner that it is not possible that the two coaxial organs are distanced from each other during the transfer of the bobbin from the shaft to the mandrel.

Another purpose of the invention is to achieve a device which will allow the automatic release of the two mandrels, once the transfer of the bobbin from one mandrel to the other mandrel has been completed.

A further purpose of the invention is to achieve a device which will allow the automated transfer of the bobbin from the first mandrel to the second mandrel without there being any need of manual intervention directly on the bobbin.

BRIEF DESCRIPTION OF THE DRAWINGS

These and other characteristics of the invention will become clear from the following description of two preferred forms of embodiment, given as non-restrictive examples with the aid of the attached drawings wherein.

DETAILED DESCRIPTION OF PREFERRED EMBODIMENT

Figure 1:
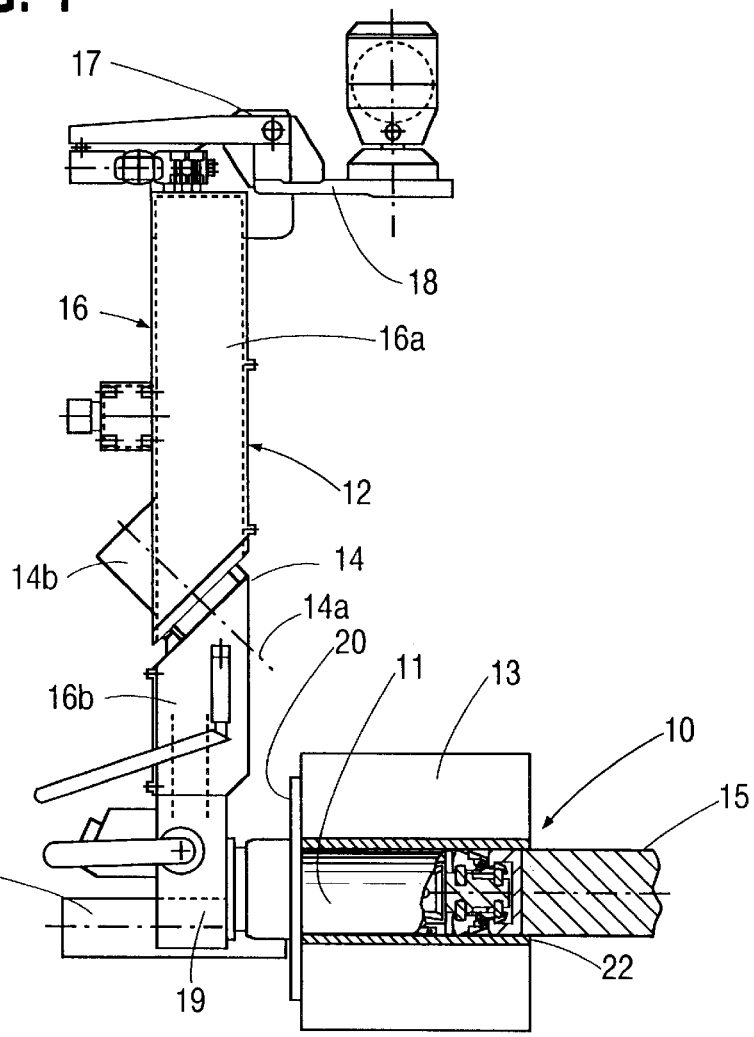
FIG. 1 is a side view, partly in section, of a device according to the invention in a first form of FIG. 2 is an enlarged detail of the device in FIG. 1 in the attached position.

With reference to the attached drawings, a device 10 according to the invention is shown applied to a cylindrical shaft or mandrel 11 of an apparatus 12 to transfer a bobbin 13 from a work station, which-is not shown in the drawings, to a second mandrel 15 of a machine not shown in the drawing.

The apparatus 12 is of a known type and is only shown here in diagram form, for the sake of simplicity; it comprises a support vertical arm 16, pivoting on a pin 17 mounted on an upper trolley 18, which can slide on fixed guides. The support arm 16 comprises an upper part 16*a* and a lower part 16*b* and is articulated in an intermediate zone 14 in such a manner that the lower part 16*b* can assume any angular position with respect to the upper part 16*a*. The joint axis 14*a* is inclined of 45° with respect to the vertical axis of the upper part 16*a* of the support arm 16. An actuator 14*b* is able to drive the inclination of the lower part 16*b* with respect to the upper part 16*a*.

To the lower end 19 of the lower part 16*b* of the arm 16 the mandrel 11 is attached cantilevered; coaxial to the mandrel 11 an extraction ring 20 is arranged which is suitable to be displaced axially commanded by an actuator 21 which can be of the hydraulic or pneumatic type.

The outer diameter of the mandrel 11 and the mandrel 15 are substantially equal to the inner diameter of the central tube or nucleus 22 on which the bobbin 13 is wound.

The device 10 (FIG. 2) comprises a pair of longitudinal slits 30 and 31 made on diametrically opposite sides on the cantilevered terminal part of the mandrel 11.

Two levers 32 and 33 are inserted into the slit 30, and are both pivoted on a transverse pin 34.

The lever 32 is thrust towards the outside of the slit 30, clockwise with respect to the pin 34, by a spring 36, while the lever 33 is thrust towards the outside of the slit 30, anti-clockwise with respect to the pin 34, by a spring 37. The spring 36 is stronger than the spring 37 and exerts a greater force on the lever 32 than that exerted by the spring 37 on the lever 33.

The lever 32 is provided at one end with a tooth 38 which cooperates with a corresponding tooth 39 made at one end of the lever 33, which has an abutment tooth 40 made at the other end.

In an identical way, two levers 42 and 43 are inserted into the slit 31, and are both pivoted on a transverse pin 44.

The lever 42 is thrust towards the outside of the slit 31, anti-clockwise with respect to the pin 44, by a spring 46, while the lever 43 is thrust towards the outside of the slit 31, clockwise with respect to the pin 44, by a spring 47. The spring 46 is stronger than the spring 47 and exerts a greater force on the lever 42 than that exerted by the spring 47 on the lever 43.

The lever 42 is provided at one end with a tooth 48 which cooperates with a corresponding tooth 49 made at one end of the lever 43, which has an abutment tooth 50 made at the other end.

The mandrel 15 has a terminal part 55 on which a circular throat 56 is made which defines an inner shoulder 57, on which the abutment teeth 40 and 50 of the levers 33 and respectively 43 are suitable to be attached, as will be described hereafter.

Figure 3:
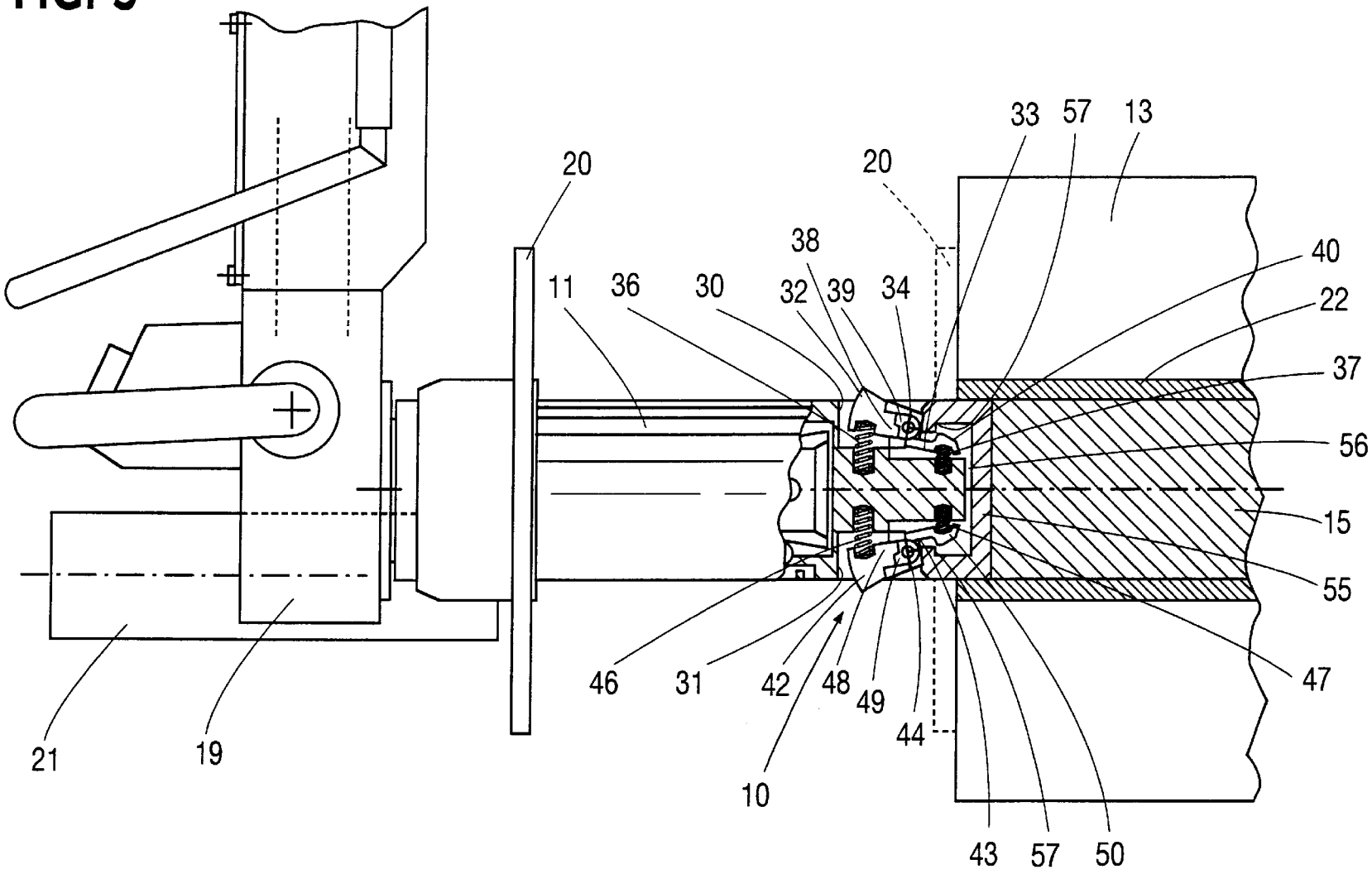
FIG. 3 is an enlarged detail of the device in FIG. 1 in the release position.

The device 10 described heretofore functions as follows:

In the inactive or release position shown in FIG. 3, with the mandrel 11 free and not inserted into any bobbin 13, the levers 32 and 42, thrust by the respective springs 36 and 46, protrude slightly with respect to the peripheral surface of the mandrel 11. In their turn the levers 32 and 42 hold the levers 33 and 43 against the bottom of the slits 30 and 31, overcoming the action of the springs 37 and 47 which, as we have seen, apply a lesser force than that applied by the springs 36 and 46.

In this position the mandrel 11 can easily be inserted into the central tube 22 of a bobbin 13, or freely distanced from the mandrel 15.

The axial insertion of the mandrel 11 inside the tube 22 of the bobbin 13 causes the protruding part of the levers 32 and 42 to retreat inside the slits 30 and 31, against the action of the springs 36 and 46, which are compressed.

Figure 2:
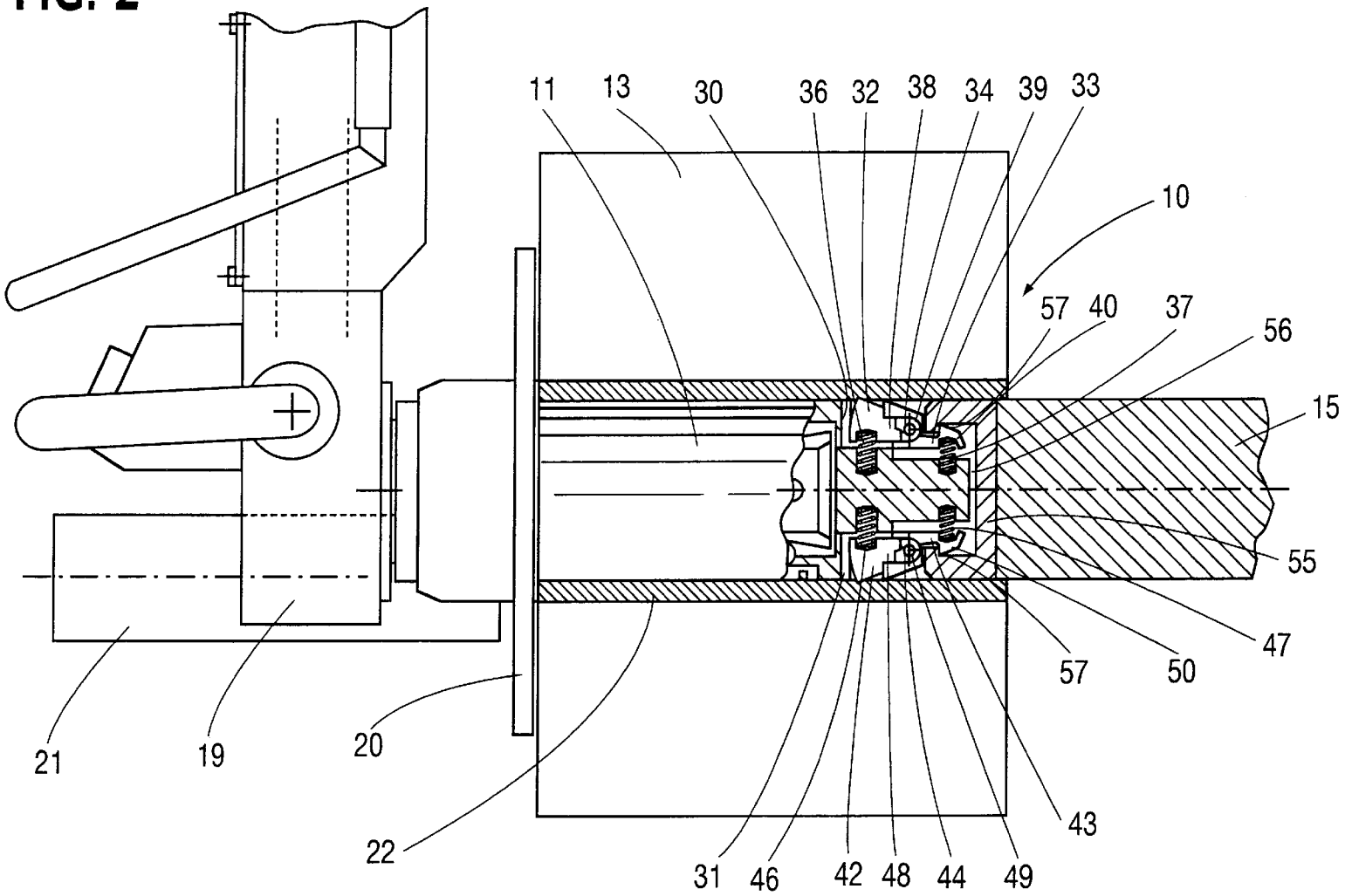

The levers 33 and 43, thrust by the corresponding springs 37 and 47, follow the levers 32 and 42 and are arranged substantially parallel to the central axis of the mandrel 11, in the attached position (FIG. 2).

When we wish to transfer the bobbin 13, mounted on the mandrel 11 of the apparatus 12, onto the other mandrel 15, first of all we position the first mandrel 11 coaxial with the second mandrel 15 and we then displace the apparatus 12 towards the second mandrel 15 itself, until the terminal part of the first mandrel 11 is inserted into the circular throat 56 of the terminal part 55 of the second mandrel 15.

This insertion causes the first mandrel 11 to be automatically attached to the second mandrel 15; the levers 33 and 43, thrust against the terminal part 55 of the mandrel 15, first rotate towards the inside of the slits 30 and 31, against the action of the springs 37 and 47, and subsequently, they return to the attachment position due to the action of the same springs 37 and 47, with their respective abutment teeth 40 and 50 against the inner shoulder 57.

The actuator 21 is then actuated; by means of the extraction ring 20, this axially displaces the bobbin 13 onto the second mandrel 15, removing it from the first mandrel 11. The latter remains attached to the second mandrel 15 and thus prevents the apparatus 12 from oscillating around the upper pin 17.

When the bobbin 13, thrust by the ring 20, passes the area of the levers 32 and 42, the latter, thrust by the springs 36 and 46, return to the initial position, as do the levers 33 and 43 with them.

Once the displacement of the bobbin 13 has been completed, and the extraction ring 20 has reached the position shown by a line of dashes in FIG. 3, the actuator 21 is actuated to return the ring 20 to the inactive position and the apparatus 12 can easily be displaced, as the first mandrel 11 has been detached automatically from the second mandrel 15.

Figure 4:
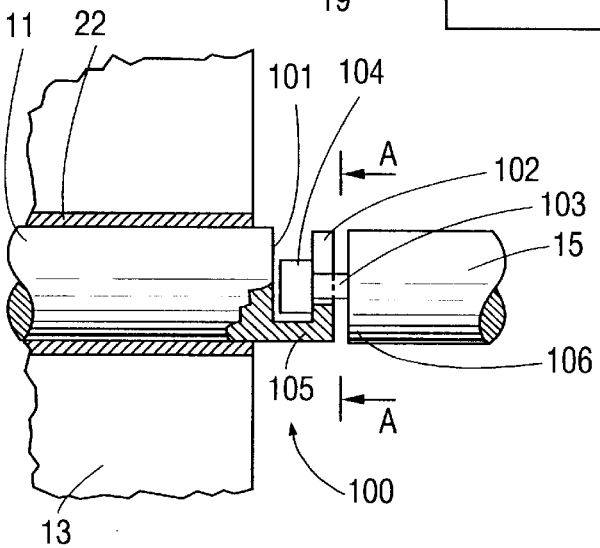
FIG. 4 is a side view, partly in section, of a device according to the invention in a second form of embodiment.
Figure 5:
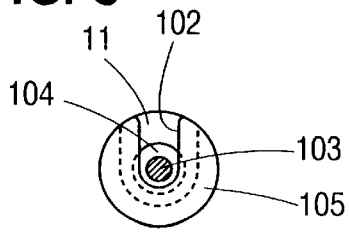
FIG. 5 is a part section along the line from A to A of FIG. 4.

According to a second, simplified form of embodiment, a device 100 (FIGS. 4 and 5) according to the invention, comprises a transverse groove 101 and a radial slit 102 made on the terminal part 105, cantilevered, of the first mandrel 11.

On the terminal part 106 of the second mandrel 15, and coaxial thereto, a cylindrical head 104 is attached by means of a connection pin 103.

This simplified variant of the device 100 allows the first mandrel 11 to be attached to the second mandrel 15 by means of the guided insertion of the cylindrical head 104 into the corresponding groove 101. It can be adopted in cases when both the terminal part 105 of the first mandrel 11 and also that 106 of the second mandrel 15 emerge from the central tube 22 of the bobbin 13, since the attachment and detachment of the two organs.11 and 15 also requires them to be relatively displaced in a transverse direction, which would not be possible if the tube 22 remained positioned in correspondence with the terminal zones 105 and 106.

It is obvious that modifications and additions can be made to the devices to automatically attach a first bobbin-bearing shaft or mandrel to a second mandrel of a machine, as described heretofore, but these shall remain within the scope and field of the invention.

For example, instead of the levers and springs included in the first form of embodiment described above, with reference to FIGS. 1–3, it would be possible to use elastic expansion means, arranged in the terminal part of the first mandrel 11 and suitable to cooperate with an axially movable element in order to make them couple with the inner shoulder 57 of the circular throat 56 of the second mandrel 15 and thus achieve the automatic coupling of the first mandrel 11 and the second mandrel 15.

Moreover, the coupling means provided on the first mandrel 11 could be made on the second mandrel 15, and, similarly, those provided on the second mandrel 15 could be made on the first mandrel 11.

I claim:

1. A device for bearing a bobbin and automatically and axially coupling a first bobbin bearing mandrel to a second bobbin bearing mandrel wherein said first bobbin bearing mandrel is cantilevered mounted on a support element, wherein both said first and second mandrels have at least a substantially cylindrical section able to cooperate with a corresponding central hole of a bobbin, wherein said substantially cylindrical sections have substantially the same external diameter, the device comprising a first coupling member provided on one of said mandrels, and a second coupling member provided on the other of said mandrels, said second coupling member able to cooperate with said first coupling member for allowing and helping the axial shifting of said bobbin from one of said mandrels to the other of said mandrels, wherein said first coupling member comprises at least a first lever arranged in a first longitudinal slit of one of said mandrels and having a first end provided with an abutment tooth, and wherein said second coupling member comprises a corresponding shoulder able to cooperate with said abutment tooth.

2. Device according to claim 1, wherein said first coupling member is provided in correspondence with a free end of said first mandrel, and said second coupling member is provided in correspondence with a free end of said second mandrel.

3. Device according to claim 1 or 2, wherein said first coupling member comprises a second lever arranged in said first longitudinal slit and cooperating with said first lever, elastic means being provided to hold said first and second levers in reciprocal cooperation.

4. Device according to claim 3, wherein said first and second levers pivot on a single pin inserted transversely in said first longitudinal slit, said elastic means comprising a first spring compressed between said mandrel and said first lever and a second spring compressed between said mandrel and said second lever.

5. Device according to claim 4, wherein said first coupling member also comprises a third lever arranged in a second longitudinal slit of said mandrel, and having a first end provided with an abutment tooth suitable to selectively cooperate with the shoulder of said second coupling member.

6. Device according to claim 5, wherein said first coupling member also comprises a fourth lever arranged in said second longitudinal slit and cooperating with the third lever, second elastic means being provided to hold said third and fourth lever in reciprocal cooperation.

7. Device according to claim 6, wherein said third and fourth levers pivot on a single pin inserted transversely in said second slit, said second elastic means comprising a third spring compressed between said mandrel and said third lever and a fourth spring compressed between said mandrel and the fourth lever.

8. Device according to claim 5, wherein said first and second longitudinal slits are arranged on diametrically opposite sides of the central axis of said mandrel.

9. Device according to claim 1, further comprising a pushing element and an actuator to actuate the pushing element for axially shifting said bobbin with respect to said first mandrel.

10. Device according to claim 9, wherein said pushing element comprises a ring disposed perpendicularly to an axis of said first mandrel.

11. Device according to claim 10, wherein said ring is coaxially mounted with respect to said first mandrel.

12. Device according to claim 1, wherein said support element comprises an upper part and a terminal part, and is articulated in an intermediate zone in such a manner that the terminal part is able to assume any angular position with respect to the upper part.

13. Device according to claim 12, wherein a joint axis of said intermediate zone is inclined at an angle of 45° with respect to a longitudinal axis of said upper part of said support element, actuation means being provided to drive the inclination of said terminal part with respect to said upper part.

* * * * *